US005949298A

United States Patent [19]

Ives et al.

[11] Patent Number: 5,949,298

[45] Date of Patent: Sep. 7, 1999

[54] HIGH POWER WATER LOAD FOR MICROWAVE AND MILLIMETER-WAVE RADIO FREQUENCY SOURCES

[75] Inventors: R. Lawrence Ives, Saratoga; Yosuke M. Mizuhara, Palo Alto; Richard V. Schumacher, Sunnyvale; Rand P. Pendleton, Saratoga, all of Calif.

[73] Assignee: Calabazas Creek Research, Saratoga, Calif.

[21] Appl. No.: 08/956,350

[22] Filed: Oct. 23, 1997

[51] Int. Cl.[6] ..... H01P 1/26

[52] U.S. Cl. ..... 333/22 F; 333/81 B

[58] Field of Search ..... 333/22 R, 22 F, 333/81 B

[56] References Cited

U.S. PATENT DOCUMENTS 3,904,993 9/1975 James .
4,593,259 6/1986 Fox et al. .
4,661,787 4/1987 Lang ..... 333/81 B X
5,015,943 5/1991 Mako et al. .

FOREIGN PATENT DOCUMENTS 1244737 7/1986 U.S.S.R. ..... 333/22 F

*Primary Examiner*—Paul Gensler
*Attorney, Agent, or Firm*—Jay A. Chesavage

[57] ABSTRACT

A high power water load for microwave and millimeter wave radio frequency sources has a front wall including an input port for the application of RF power, a cylindrical dissipation cavity lined with a dissipating material having a thickness which varies with depth, and a rear wall including a rotating reflector for the reflection of wave energy inside the cylindrical cavity. The dissipation cavity includes a water jacket for removal of heat generated by the absorptive material coating the dissipation cavity, and this absorptive material has a thickness which is greater near the front wall than near the rear wall. Waves entering the cavity reflect from the rotating reflector, impinging and reflecting multiple times on the absorptive coating of the dissipation cavity, dissipating equal amounts of power on each internal reflection.

9 Claims, 2 Drawing Sheets

HIGH POWER WATER LOAD FOR MICROWAVE AND MILLIMETER-WAVE RADIO FREQUENCY SOURCES

This invention was made with U.S. Government support under grant DE-FG03-95ER81938 awarded by the Department of Energy. The U.S. Government has certain rights in this invention.

FIELD OF THE INVENTION

The current invention applies to the field of radio frequency load devices, particularly the class of radio frequency load accepting as input wave energy traveling in circular or rectangular waveguides, such waves having wavelengths on the order of millimeters to micrometers.

BACKGROUND OF THE INVENTION

Calorimetric loads have always been useful elements for testing RF equipment. This class of load converts RF wave energy into thermal energy that can be removed by a circulating coolant such as water. The power delivered to the load is measured by monitoring the temperature change of the circulating fluid, and is determined by the formula $$Q=f\Delta TCp,$$

Where Q=heat removed (Watts),
Cp=specific heat of the circulating fluid (cal/g°C.),
ΔT is the temperature difference between input and output ports of the load in °C.,
And f=flow rate of the fluid (1/min).

As an example, a 1° C. rise in a fluid having a flow rate of 1 liter/minute indicates a power dissipation of 66 watts. There are several mechanisms wherein radio frequency energy is converted into heat. The principal class involves bulk resistive materials, wherein a material having E/H wave resistive properties is applied to a surface. Incoming waves are attenuated as they travel through this material until they are encounter the reflective surface. A typical choice for such a resistive material is carbon powder, which has a bulk resistance roughly of p=3000 Ω-cm.

A second mechanism for the dissipation of RF energy is the creation of magnetic eddy currents. This requires the use of a bulk ferrite, or other material magnetically coupled to short wave RF, which interacts with and attenuates the RF wave energy through the creation of eddy currents at the discontinuous interface. These eddy currents produce an electric field, which is dissipated in the resistivity of the absorbing material.

A third mechanism is the interaction of the incoming waves with a material which has a high dielectric loss for the applied wave frequency. At radio frequencies of above 10 Ghz, the absorption of water is sufficiently high to enable the use of water both as a coolant and load fluid. Another problem relative to high power density loads is the creation of very high heat loads and the dissipation and temperature limits encountered in removing the resultant heat load. An example of adding structures to the load to assist in heat removal is U.S. Pat. No. 3,904,993 High Power Microwave Load by James which discloses a load comprising a chamber with a lossy material. This chamber is further divided into sections which reduce the maximum internal voltage levels, as well as provide a heat conduction path for removing heat from the lossy material and directing it to the waveguide exterior.

An attenuative load utilizing the dielectric loss of water is discussed in U.S. Pat. No. 4,593,259 by Fox et al. his patent discloses a load comprising a conical reflector which is surrounded by a material having a high loss tangent dielectric constant fluid such as water. The conical reflector serves to direct input waves onto a multi-reflection path through the attenuative water media, so that a minimum of reflected wave energy is directed back to the wave source. One of the disadvantages of the use of water as the direct attenuative material is the initial discontinuity in impedance between the waveguide and the water interface. This discontinuity will result in the reflection of some fraction of the incoming wave power according to the relationship $$\frac{Pr}{Pi}=\Gamma^2=\left|\frac{(Zr-Zo)^2}{(Zr+Zo)^2}\right|$$

Where

Pr=power reflected back to waveguide

Pi=incident power from waveguide

Zr=reflection interface impedance

Zo=waveguide impedance

The effect of this interface is that some fraction of the wave energy will be returned to the source, and cause standing waves to appear in the waveguide, thereby producing excessive electric fields within the waveguide, and ultimately limiting the maximum input power. U.S. Pat. No. 5,015,943 by Mako et al describes a means for measuring microwave radio frequency waves by measuring the thermal expansion of the heated material, either by using directly optical fiber in conjunction with an interferometer, or through the use of a linear motion transducer such as a piezoelectric crystal. This method limits the input power level of the RF load to the deformation temperature of the fiber optic sensor, although it can be accurate for lower temperature measurements associated with low incident power.

OBJECTS OF THE INVENTION

A first object of the invention is to provide a high power RF load device for microwave and millimeter wave frequencies. Anther object of the invention is to provide an RF calorimeter for the measurement of dissipated RF power. Another object of the invention is to provide an RF load device which provides a good impedance match for both circular and rectangular waveguides.

SUMMARY OF THE INVENTION

The present invention is directed to a fluid-cooled RF load used in the testing of high power radio frequency (RF) sources having wavelengths from millimeters to micrometers. A cavity lined with a variable-thickness RF absorptive coating axially receives incoming RF wave energy, which is reflected by a rotating reflector element to be reflected and dissipated in this variable thickness RF absorptive coating. The geometry of the cavity encourages multiple reflections from the inner walls, and the coating thickness of this cavity is varied according to the local incident power level to promote the dissipation of RF wave energy uniformly over the length of the cavity. For example, if the incident wave power on a first reflection were 1000 W/cm$^2$, and the maximum surface power density were 250 W/cm$^2$, then the surface would be designed for 250 W absorption per reflection over 4 reflections, which would result in 750 W/1000 W=1.2 dB loss on first reflection, 500 W/750 W=1.7 dB loss on second reflection, 250 W/500 W=3 dB loss on third reflection, 2.5 W/250 W=20 dB loss on fourth reflection.

Accordingly, the thickness of the absorptive material would vary according to the dB level of loss desired for each reflection. Additionally, the geometry of the cavity minimizes reflected wave coupling back into the input port.

DETAILED DESCRIPTION OF THE INVENTION

Figure 1:
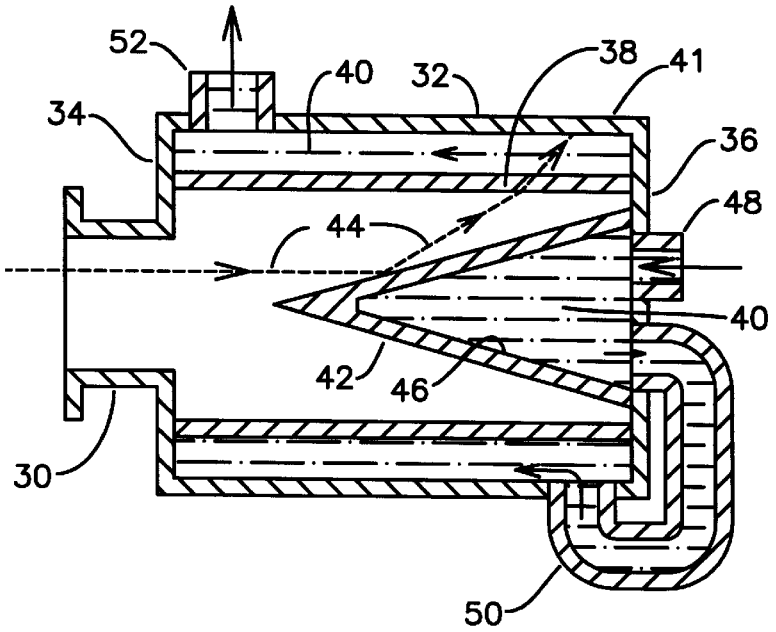
Figure 1 Prior Art
FIG. 1 is a section view of a prior art water load for circular electric waveguide modes at frequencies below 100 GHz and power levels below 200 kW CW.

FIG. 1 shows the prior art radio frequency load of U.S. Pat. No. 4,593,259, which is suitable for circularly polarized waves conducted through circular waveguides. Incoming waves propagate through waveguide 30 and impinge on reflecting metallic surface 42 where the incoming wave is reflected radially outward. It propagates through a dielectric cylinder 38 and is absorbed in a coolant fluid 40. Conductive enclosures 32, 34, and 36 contain the cooling fluid 40 and reflect waves back into cooling fluid 40. Fluid inlet 48 and fluid outlet 52 enable the measurement of temperature rise for the calculation of dissipated power. Bypass 50 enables the coolant to circulate from the main reflector 42 to the circularly symmetric outer chamber. This device is capable of CW operation up to 200 kilowatts (kW) for frequencies below 100 gigahertz (GHz).

Figure 2:
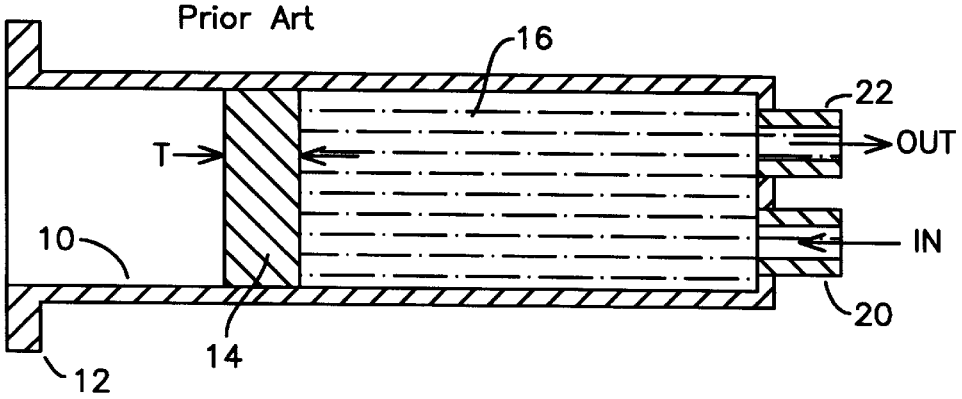
Figure 2 Prior Art
FIG. 2 is a section view of a prior art water load having either a circular or rectangular input waveguide.
Figure 3:
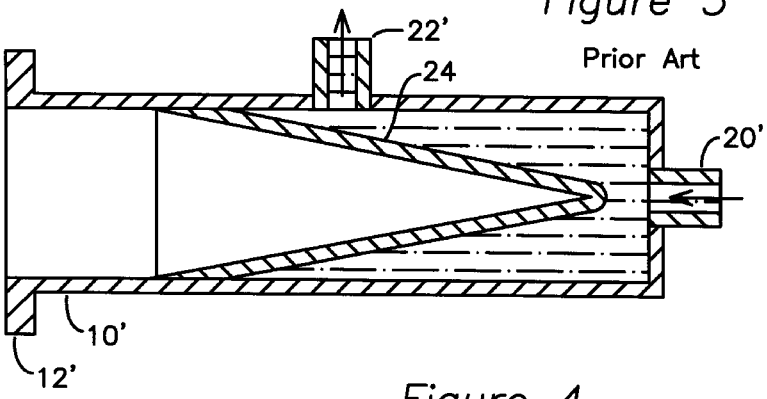
Figure 3 Prior Art
FIG. 3 is a section view of a prior art water load for a circular waveguide using a conical ceramic window.

Alternative embodiments shown in FIGS. 2 and 3 are from U.S. Pat. No. 3,445,789. In FIG. 2, the RF wave propagates through waveguide 10 and passes through ceramic material 14 where the power is absorbed in coolant 16 which is delivered to the cooling chamber via port 20 and thereafter exhausted through port 22. This embodiment is compatible with rectangular and circular waveguides and can operate at CW power levels on the order of 10 kilowatts. The device of FIG. 3 operates on circularly polarized, overmoded waves. Single mode waves typically have wave intensity distributions of a bessel function Jo(r), while higher order waves may have superpositions of bessel functions of higher order, including steep skirts on the sidewalls adjacent to the waveguide. These overmoded RF waves propagate through the ceramic cone 24 into the fluid coolant. The other components 20', 22', 10', and 12' have the same function as described in FIG. 2. The ceramic cone 24 is an expensive part and difficult to manufacture to the required tolerances. Grinding the inside of the narrow cone is particularly difficult. This type of water load is useful at power levels up to about 200 kW CW at frequencies below 100 GHz. It is only applicable for circular waveguide modes.

There are distinct limits to the power levels that devices directly absorbing RF power such as the prior art devices of FIGS. 1, 2, and 3 can tolerate. Devices that absorb RF power within the coolant fluid utilize the dielectric loss of the coolant to convert the wave energy to thermal energy. This requires the attenuation of the RF power to be distributed throughout a sufficient volume of the coolant fluid to avoid boiling near the ceramic material. The volume in which the power is dissipated depends on the skin depth of the RF wave in the fluid coolant, which is the depth at which the power level is attenuated to 1/e of its incident value. At microwave frequencies, this value is on the order of 1 centimeter, but at frequencies exceeding 100 GHz, the value drops to a few millimeters. This means the total incident power is absorbed within the first few millimeters of the coolant fluid resulting in immediate boiling at high power levels. This can result in high reflected power back toward the RF source and catastrophic damage to the water load. Consequently, devices that depend on RF absorption within the coolant fluid are not practical for high power levels above 100 GHz.

This invention describes a high power water load used for testing microwave and millimeter wave radio frequency (RF) sources with the wave energy propagating in a Gaussian quasi-optical mode. The device described here is designed to dissipate the RF power on absorbing surfaces and to remove the resultant heat using a water or alternative fluid coolant. A rotating reflector comprising oxygen free, high conductivity copper sweeps the incident RF radiation circumferentially around the main load structure to evenly distribute the thermal power and to compensate for misalignment in the RF beam. The RF loss of the internal surfaces is controlled to prevent excessive localized heating and to improve uniformity of the power dissipation.

The present invention provides a water load capable of dissipating high RF power levels at frequencies between 100 GHz and 200 GHz, though its applicability may extend to lower and higher frequencies. In the main embodiment, the device is designed for use with devices producing RF power in a Gaussian mode which does not depend on waveguide wall currents for propagation. The incident RF beam is focused through an aperture into the main load section. The device uses a lossy coating deposited on a metallic surface cooled by a fluid, such as water. A rotating reflector distributes the RF power over the lossy surface to prevent excessive dissipation in any area and automatically compensates for misalignment in the incident RF beam.

Figure 4:
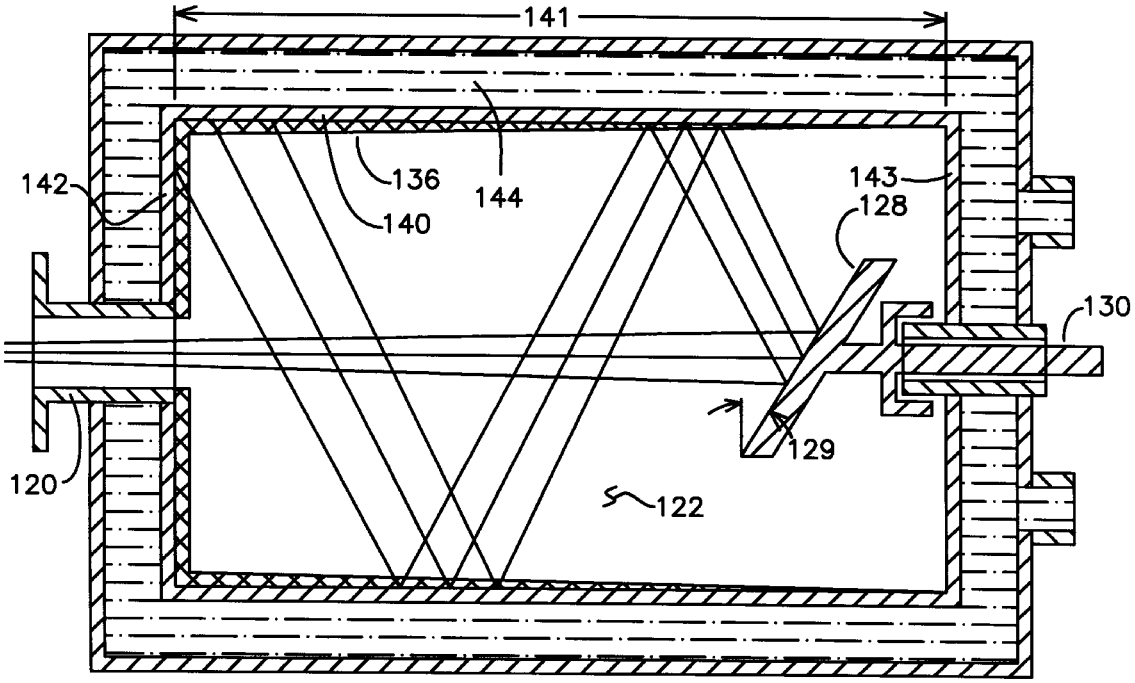
FIG. 4 is a section view of the main embodiment of the current invention.

The present invention is shown in FIG. 4. Rays of RF power 110 enters through aperture 120 into the cylindrical load section 122. The RF beam impinges on rotating reflector 128 attached to shaft 130. Reflector 128 reflects the RF wave and sweeps it around the structure such that the power impinges on lossy material 136, which has the properties of high temperature tolerance, high thermal conductivity, and high dielectric or eddy current loss for RF waves of the frequency of interest. For the present invention, it has been found that titanium dioxide sold under the common name black futile has the desired properties, which include a reflective attenuation on the order of 20 dB for a coating of 0.020 inch thick. This black rutile is applied to interior surfaces 140, 142, and 143 with a thickness range of from 0 to 0.020 inch, and the best application method is successively applied plasma spray coatings of between 0.0005 to 0.001 inch per coating. The reflector angle 129 of reflector 128 and the thickness of loss coating 136 are controlled such that a portion of the RF wave is absorbed and the remainder is reflected across the axis of the section to impinge on the opposite wall. The thickness of the loss coating is controlled so that greater loss occurs as the power density in the beam is dissipated, such that substantially all power is absorbed before the reflected wave reaches front wall 142, and such that the RF power absorption loss is uniformly distributed over the length 141 of the cavity 122. RF power absorbed by the loss material 136 is converted to thermal energy which is conducted through metallic wall 140 and removed by fluid coolant 144. Front wall 142 has properties to discourage the reflection of RF waves back into input port 120. One such property is a thick coating of RF absorbing material 136, which may be combined with a surface profile which is convex to internally reflected waves. Rear wall 143 may be similarly constructed as front wall 142 to discourage the reflection of waves into the input port 120.

Having described a preferred embodiment of the invention, it should now be apparent to those skilled in the art that the previously described advantages for the system have been achieved. Although the present invention was described in connection with the preferred embodiment, it is evident that numerous alternatives, modifications, variations, and uses will be apparent to those skilled in the art in light of the foregoing description.

We claim:

1. An RF load comprising:

an electrically conductive dissipation cavity having a cylindrical elongate body;

a heat-removing fluid circulating around the exterior of said dissipation cavity;

a front wall located at one end of said dissipation cavity and having an input port for the application of radio-frequency wave energy;

a rear wall positioned at the opposite end of said body said rear wall including a rotating reflector;

said dissipation cavity inner surface having a radio-frequency absorptive material applied wherein the thickness of said absorptive material varies from a larger thickness near said front wall to a smaller thickness near said rear wall;

said rotating reflector having a planar reflection surface and accepting wave energy applied to said waveguide input port and directing said wave energy to said radio-frequency absorptive material at an oblique angle to said absorptive material.

2. The RF load of claim 1 wherein said absorptive material comprises black rutile.

3. The RF load of claims 1 or 2 wherein said front wall is non-planar, and has a convex surface facing said dissipation cavity.

4. The RF load of claims 1 or 2 wherein said rear wall is non-planar, and has a convex surface facing said dissipation cavity.

5. The RF load of claims 1 or 2 wherein said reflector has a surface exposed to said radio frequency wave energy entering from said input port, the material of said surface comprising oxygen free, high conductivity copper.

6. The load of claim 1 or claim 2 wherein said oblique angle and said absorbing material thickness are chosen to dissipate equal amounts of power on each internal reflection.

7. The RF load of claims 1 or 2 wherein said front wall has an absorptive surface facing said dissipation cavity.

8. The RF load of claims 1 or 2 wherein said rear wall has an absorptive surface facing said dissipation cavity.

9. The RF load of claims 1 or 2 wherein said oblique angle is chosen to minimize the amount of said applied radio-frequency wave power which reflects to said input port, and said absorptive coating thickness is chosen to uniformly dissipate said radio-frequency wave power on each of said reflections.

* * * * *